US009507314B2

(12) United States Patent
Yamauchi

(10) Patent No.: US 9,507,314 B2
(45) Date of Patent: Nov. 29, 2016

(54) IMAGE FORMING APPARATUS

(71) Applicant: CANON KABUSHIKI KAISHA, Tokyo (JP)

(72) Inventor: Hisashi Yamauchi, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/844,239

(22) Filed: Sep. 3, 2015

(65) Prior Publication Data

US 2016/0070200 A1 Mar. 10, 2016

(30) Foreign Application Priority Data

Sep. 4, 2014 (JP) ..... 2014-179992

(51) Int. Cl.
*G03G 21/10* (2006.01)

(52) U.S. Cl.
CPC .... *G03G 21/105* (2013.01); *G03G 2215/0132* (2013.01)

(58) Field of Classification Search
None
See application file for complete search history.

(56) References Cited

U.S. PATENT DOCUMENTS

2002/0127021 A1* 9/2002 Chihara ..... G03G 15/553 399/12
2013/0028618 A1* 1/2013 Ando ..... G03G 21/105 399/35

FOREIGN PATENT DOCUMENTS

JP 2007-183440 A 7/2007

* cited by examiner

*Primary Examiner* — David Gray
*Assistant Examiner* — Thomas Giampaolo, II
(74) *Attorney, Agent, or Firm* — Fitzpatrick, Cella, Harper & Scinto

(57) ABSTRACT

An image forming apparatus includes: an image bearing member; a developer carrying member for carrying developer; a cartridge detachably mountable to a main assembly of the image forming apparatus, the cartridge includes a cleaning means for removing the developer remaining on the developer carrying member after a developer image is transferred onto a transfer material, a developer buffering portion for accommodating the developer removed by the cleaning portion, and a feeding member driven for feeding the developer from the developer buffering portion to a developer container provided in the main assembly; a storing portion for storing cartridge operation information; and a controller for controlling the feeding member to stop drive of the feeding member on the basis of the cartridge operation information stored in the storing portion.

18 Claims, 6 Drawing Sheets

IMAGE FORMING APPARATUS

FIELD OF THE INVENTION AND RELATED ART

The present invention relates to an image forming apparatus, of an electrophotographic type, such as a copying machine, a printer or a facsimile machine.

Conventionally, in a process cartridge detachably mountable to an electrophotographic image forming apparatus, transfer residual toner, which is developer remaining on an image bearing member after transfer, is removed from the image bearing member. Thereafter by a feeding member attached to the process cartridge, the transfer residual toner is fed to a residual toner (waste toner) container attached to the image forming apparatus. Such an image forming apparatus has been known (Japanese Laid-Open Patent Application (JP-A) 2007-183440). JP-A 2007-183440 discloses, as one of the structures for feeding the transfer residual toner from the process cartridge to the residual toner container attached to the image forming apparatus, a structure in which a feeding speed of the feeding member is controlled depending on a print ratio per page and an operation environment.

However, in the thus-constituted image forming apparatus, the transfer residual toner was continuously fed from the process cartridge to the residual toner container (developer container) attached to the image forming apparatus, and therefore it was difficult to extend a lifetime of the residual toner container attached to the image forming apparatus. In addition, in the case where a residual toner buffering portion (developer buffering portion) attached to the process cartridge is provided, when the transfer residual toner is continuously fed from the residual toner buffering portion to the residual toner container attached to the image forming apparatus throughout a lifetime of the process cartridge, the following problem arose. That is, a space in the residual toner buffering portion (developer buffering portion) attached to the process cartridge was unable to be used effectively.

SUMMARY OF THE INVENTION

A principal object of the present invention is to provide an image forming apparatus capable of realizing lifetime extension of a residual toner container (developer container) using a developer buffering portion without relying on an increase in space of the residual toner container (developer container) attached to the image forming apparatus.

According to an aspect of the present invention, there is provided an image forming apparatus comprising: an image bearing member; a developer carrying member for carrying developer; a cartridge detachably mountable to a main assembly of the image forming apparatus, the cartridge includes cleaning means for removing the developer remaining on the developer carrying member after a developer image is transferred onto a transfer material, a developer buffering portion for accommodating the developer removed by the cleaning means, and a feeding member driven for feeding the developer from the developer buffering portion to a developer container provided in the main assembly; storing means for storing cartridge operation information; and control means for controlling the feeding member to stop drive of the feeding member on the basis of the cartridge operation information stored in the storing means.

These and other objects, features and advantages of the present invention will become more apparent upon a consideration of the following description of the preferred embodiments of the present invention taken in conjunction with the accompanying drawings.

DESCRIPTION OF THE EMBODIMENTS

Hereinbelow, embodiments of the present invention will be specifically described with reference to the drawings.

First Embodiment

Image Forming Apparatus

First, a general structure of an electrophotographic image forming apparatus in this embodiment according to the present invention will be described.

Figure 1:
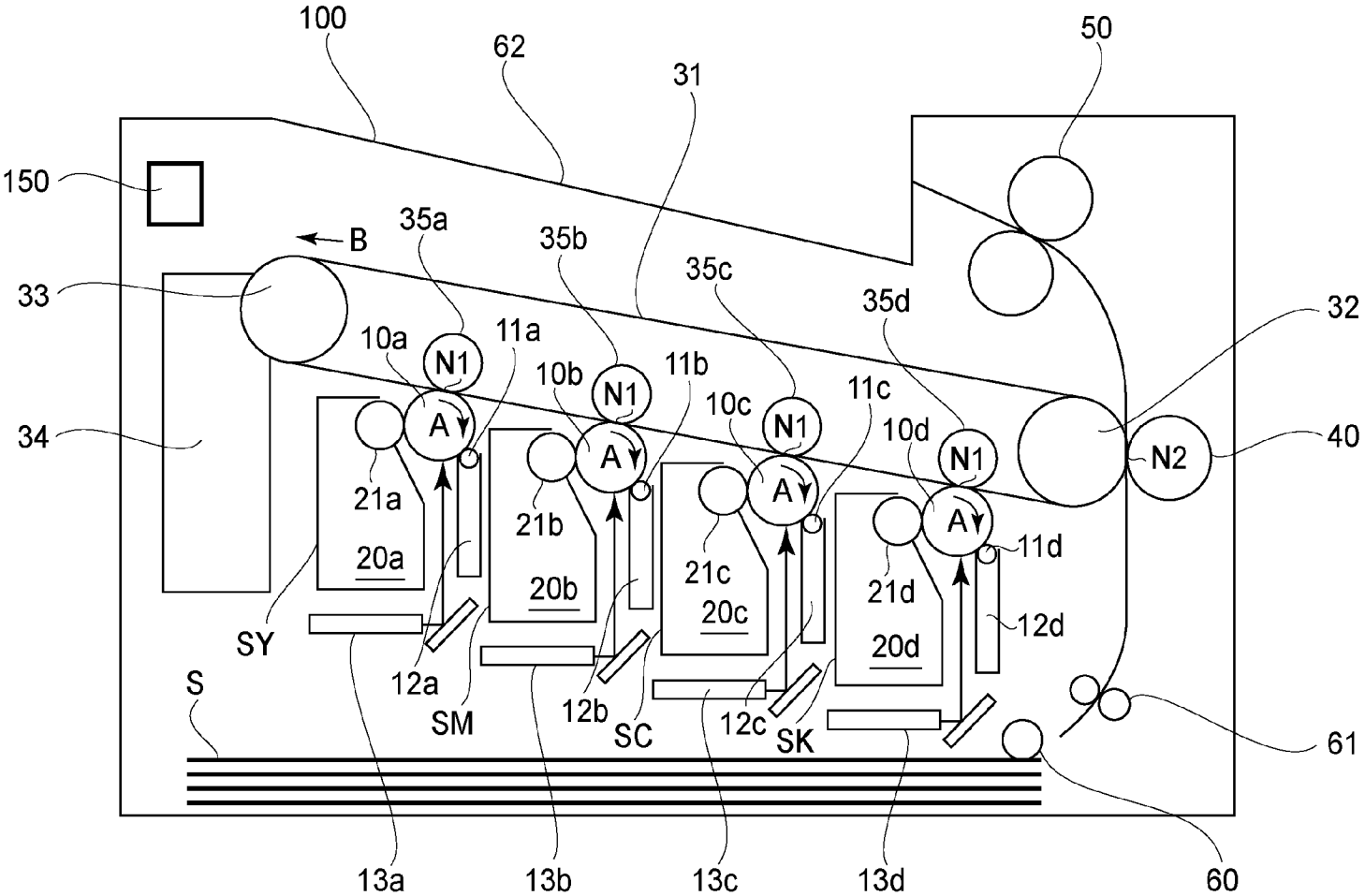
FIG. 1 is a schematic view for illustrating an image forming apparatus according to a First Embodiment of the present invention.

FIG. 1 is a schematic sectional view of an image forming apparatus.

The image forming apparatus in this embodiment is a full-color laser beam printer employing an in-line type and an intermediary transfer type.

An apparatus main assembly 100 of the image forming apparatus includes, as a plurality of process cartridges which are detachably mountable to the apparatus main assembly 100 and which are provided correspondingly to a plurality of colors, first to fourth process cartridges SY, SM, SC and SK for forming images of colors of yellow (Y), magenta (M), cyan (C) and black (K), respectively. In this embodiment, the first to fourth process cartridges are disposed in line along a direction crossing a vertical direction.

Constitutions and operations of the first to fourth process cartridges are the substantially same except that the colors of the images to be formed are different from each other. Accordingly, in the case where the process cartridges are not particularly required to be distinguished from each other, suffixes Y, M, C and K added to reference numerals for representing elements for the associated colors are omitted, and the elements for the associated colors will be collectively described.

In this embodiment, the image forming apparatus includes, as a plurality of image bearing members, four drum-shaped electrophotographic photosensitive members juxtaposed along the direction crossing the vertical direction, i.e., photosensitive drums 10 as the photosensitive members. Each of the photosensitive drums 10 is rotationally driven by an unshown driving system (driving source) in an arrow A direction (clockwise direction) indicated in FIG. 1.

At a periphery of the photosensitive drum 10, a charging roller 11 and a scanner unit 13 (exposure device) are provided. The charging roller 11 is a charging means for electrically charging a surface of the photosensitive drum 10 uniformly. The scanner unit 13 (exposure device) is an exposure means for forming an electrostatic image (electrostatic latent image) on the photosensitive drum 1 by irradiating the photosensitive drum surface with laser light depending on image information. Further, at the periphery of the photosensitive drum 10, a developing unit (developing device) 20 and a cleaning unit 12 (FIG. 2) including a cleaning blade 210 as a cleaning means are provided.

The developing unit 20 is a developing means developing the electrostatic image into a toner image (developer image). The cleaning unit 12 (FIG. 2) removes toner (transfer residual toner) remaining on the surface of the photosensitive drum 10 after transfer. Further, as an intermediary transfer member, an intermediary transfer belt 31 for transferring the toner image from the photosensitive drum 10 onto a recording material S is provided opposed to the four photosensitive drums 10.

Along a rotational direction of the photosensitive drum 10, a charging position by the charging roller 11, an exposure position by the scanner unit 13, a developing position by the developing unit 20, a transfer position of the toner image onto the intermediary transfer belt 31, and a cleaning position by the cleaning unit 12 are provided in the listed order.

In this embodiment, the developing unit 20 uses, as developer, non-magnetic one-component developer, i.e., toner. Further, the developing unit 20 performs reverse development by bringing a developing roller 21 (described later) as a toner carrying member (developer carrying member) into contact with the photosensitive drum 10.

That is, in this embodiment, the developing unit 20 deposits the toner, charged to the same polarity (negative in this embodiment) as the charge polarity of the photosensitive drum 10, on a portion (image period, exposed portion) where an electric charge is attenuated by the exposure of the photosensitive drum 10 to light. As a result, the electrostatic image on the photosensitive drum 10 is developed.

In this embodiment, all the process cartridges as cartridges for the respective colors have the same shape and accommodate the toners of the respective colors of yellow (Y), magenta (M), cyan (C) and black (K), respectively. The intermediary transfer belt 31 formed with an endless belt as the intermediary transfer member contacts all the photosensitive drums 10 and circulates and moves (rotates) in an arrow B direction (counterclockwise direction) indicated in FIG. 1. The intermediary transfer belt 31 is stretched around a plurality of supporting members (a driving roller 33, a secondary transfer opposite roller 32 and a follower roller).

In an inner peripheral surface side of the intermediary transfer belt 31, as a primary transfer means, four primary transfer rollers 35 are juxtaposed so as to oppose the photosensitive drums 10.

Each of the primary transfer rollers 35 presses the intermediary transfer belt 31 toward the photosensitive drum 10 to form a nip (primary transfer nip) at a primary transfer portion N1 where the intermediary transfer belt 31 and the photosensitive drum 10 contact each other. Then, to the primary transfer roller 35, a bias of an opposite polarity to a normal charge polarity of the toner is applied from an unshown primary transfer bias voltage source (high voltage source) as a primary transfer bias application means.

As a result, the toner image is transferred (primary-transferred) from the photosensitive drum 10 onto the intermediary transfer belt 31. In an outer peripheral surface side of the intermediary transfer belt 31, as secondary transfer means, a secondary transfer roller 40 is provided at a position opposing the secondary transfer opposite roller 32. The secondary transfer roller 40 press-contacts the intermediary transfer belt 31 toward the secondary transfer opposite roller 32 to form a nip (secondary transfer nip) at a secondary transfer portion N2 where the intermediary transfer belt 31 and the secondary transfer roller 40 contact each other.

Then, to the secondary transfer roller 9, a bias of an opposite polarity to the normal charge polarity of the toner is applied from an unshown secondary transfer bias voltage source (high voltage source) as a secondary transfer bias application means.

As a result, the toner images are secondary-transferred from the intermediary transfer belt 31 onto the recording material S. The primary transfer roller 35 and the secondary transfer roller 40 have a similar constitution.

During image formation, first, the surface of the photosensitive drum 10 is uniformly charged, and then the surface of the charged photosensitive drum 10 is subjected to scanning-exposure to laser light, depending on the image information, emitted from the scanner unit 13, so that the electrostatic image is formed on the photosensitive drum 10 correspondingly to the image information.

Then, the electrostatic image formed on the photosensitive drum 10 is developed into the toner image by the developing unit 20.

The toner image formed on the photosensitive drum 10 is transferred (primary-transferred) onto the intermediary transfer belt 31 by the action of the primary transfer roller 35. For example, during full-color image formation, the above-described process is successively performed in the first to fourth process cartridges SY, SM, SC and SK, and then the toner images of the respective colors are primary-transferred superposedly onto the intermediary transfer belt 31.

Thereafter, in synchronism with movement of the intermediary transfer belt 31, the recording material S is fed to the secondary transfer portion N2. Then, by the action of the secondary transfer roller 40 contacting the recording material S toward the intermediary transfer belt 31, the four color toner images are secondary-transferred collectively from the intermediary transfer belt 31 onto the recording material S. The recording material S on which the toner images are transferred is fed to a fixing device 50 as a fixing means. In the fixing device 50, heat and pressure are applied to the recording material S, so that the toner images are fixed on the recording material S.

Further, primary transfer residual toner remaining on the photosensitive drum 10 after a primary transfer step is removed by the cleaning unit 12 (FIG. 2), and is collected in a residual toner buffering portion (developer buffering portion) 220 (FIG. 2) attached to the process cartridge. Further, secondary transfer residual toner remaining on the intermediary transfer belt 31 after a secondary transfer step is removed by a cleaning device (not shown), and is fed to a residual toner container 34 attached to the image forming apparatus.

(Process Cartridge)

Next, a general structure of the process cartridge detachably mountable to the image forming apparatus in this embodiment will be described.

Figure 2:
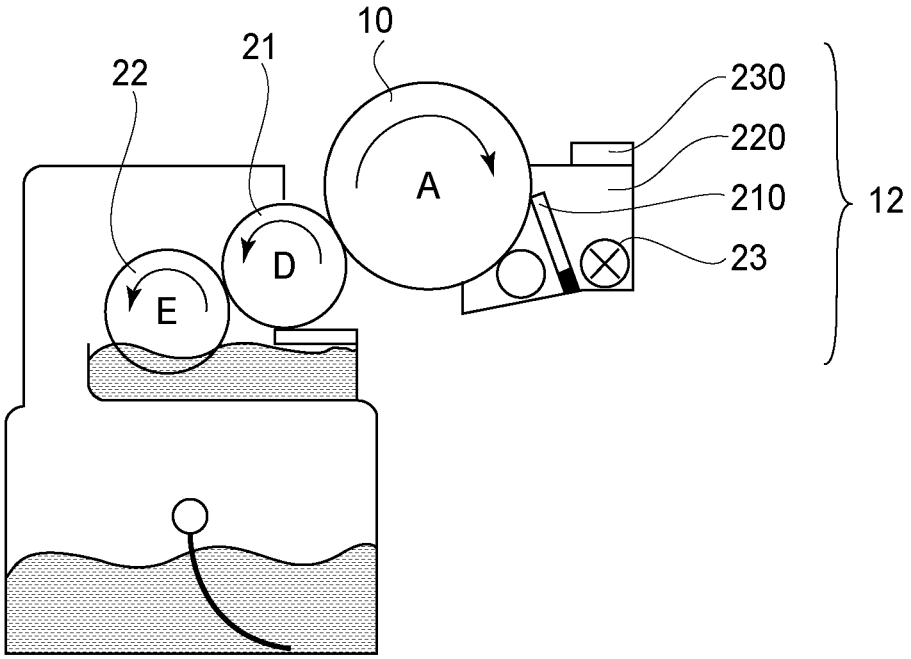
FIG. 2 is a schematic view for illustrating a process cartridge in the First Embodiment.

FIG. 2 is a schematic sectional view of the process cartridge 7 in this embodiment as seen in a longitudinal direction (rotational axis direction) of the photosensitive drum 10. In this embodiment, constitutions and the operations of the process cartridges for the respective colors are substantially the same except for species (colors) of the accommodated developer.

The process cartridge includes a photosensitive member unit including the photosensitive drum 10 and the like, the developing unit 20 including the developing roller 21 and the like, and a memory 230 (FIG. 2) as a storing means for storing operation information of the process cartridge.

The photosensitive member unit includes a cleaning frame as a frame for supporting various elements (components) in the photosensitive member unit. To the cleaning frame, the photosensitive drum 10 as the image bearing member is rotatably mounted via an unshown bearing. The photosensitive drum 10 is rotationally driven in the indicated arrow A direction (clockwise direction) depending on the image forming operation by receiving a driving force of a driving motor as an unshown driving means (driving source).

In the photosensitive member unit, the charging roller 11 and the cleaning member 12 are disposed so as to contact the peripheral surface of the photosensitive drum 10. Further, the residual toner buffering portion 220 for temporarily accommodating the transfer residual toner removed from the surface of the photosensitive drum 10 by the cleaning member 12 is formed inside the cleaning frame. The transfer residual toner removed from the surface of the photosensitive drum 10 by the cleaning member 12 is, as described hereinafter in detail, temporarily stored in the residual toner buffering portion 220 formed inside the cleaning frame. The toner stored in the residual toner buffering portion 220 formed in the cleaning frame is hereinafter referred to as residual toner.

In the cleaning frame, a bearing for the charging roller 11 is mounted. The charging roller 11 bearing is mounted movably along a line passing through a rotation center of the charging roller 11 and a rotation center of the photosensitive drum 10. A rotation shaft of the charging roller 11 is rotatably mounted to the charging roller 11 bearing. The charging roller 11 bearing is urged toward the photosensitive drum 10 by an urging spring (not shown), for the charging roller 11, as an urging means.

On the other hand, the developing unit 20 includes a developing chamber and a toner accommodating chamber. The developing chamber is provided with the developing roller 21 and a supplying roller 22. The developing roller 21 functions as a developer carrying member (toner carrying member) which opposes the photosensitive drum 10 and which rotates in an arrow D direction (counterclockwise direction) in FIG. 2 in contact with the photosensitive drum 10.

In this embodiment, the developing roller 21 and the photosensitive drum 10 rotate so that their surfaces move, at their opposing portion (contact portion), in the same direction (directed from a lower side toward an upper side in this embodiment).

Further, in the developing unit, the developer supplying roller 22 as a developer supplying member which rotates in an arrow E direction (counterclockwise direction) indicated in FIG. 2 is provided. The supplying roller 22 contacts the peripheral surface of the developing roller 217. In this embodiment, the supplying roller 22 and the developing roller 21 rotate so that their surfaces move in opposite directions at their opposing portion (contact portion). The supplying roller 22 performs the function of not only supplying the toner onto the developing roller 21 but also peeling off the toner remaining on the developing roller 21 from the developing roller 21 without being subjected to the development.

In the developing unit, a developing blade (not shown) as a developer supplying (regulating) member for regulating a layer thickness of the toner (developer) supplied on the developing roller 21 by the supplying roller 22 is provided at a position where the developing blade contacts the peripheral surface of the developing roller 21. The toner accommodating chamber as a developer accommodating chamber formed inside a developing (device) frame is disposed under the developing chamber, and accommodates the non-magnetic one-component developer as the developer, i.e., the toner.

Between the developing chamber and the toner accommodating chamber, a partition wall provided with an opening for permitting passing of the toner is provided. The opening is disposed on the toner accommodating chamber. In the toner accommodating chamber, a toner feeding member rotatably supported by the developing frame is provided. Further, the toner accommodating chamber is provided with a light-guiding member for permitting light transmission in order to detect a toner amount in the toner accommodating chamber by an optical sensor attached to the image forming apparatus. On the other hand, in a storing device for storing an operation (use) status of the process cartridge, an operation (use) environment, a print number, an average print ratio per (one) sheet, a remaining toner amount (remaining developer amount), a lifetime of the photosensitive drum 10, a lifetime of the developing roller, and the like are stored.

(Residual Toner Feeding Member)

Figure 3:
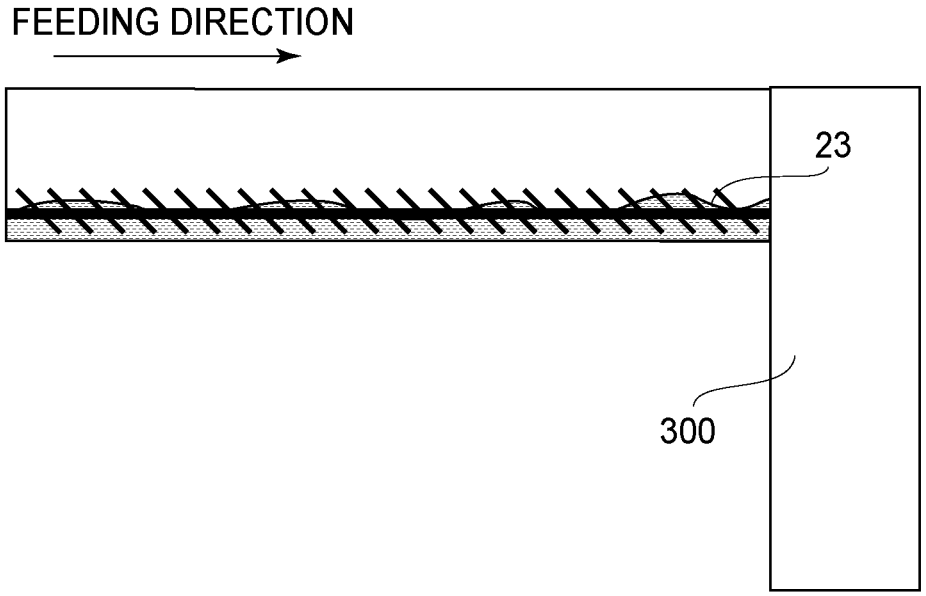
FIG. 3 is a schematic view for illustrating a residual toner buffering portion in the First Embodiment.

A residual toner feeding member in the residual toner buffering portion attached to the process cartridge in this embodiment will be specifically described. FIG. 3 is a schematic sectional view of the residual toner buffering portion attached to the process cartridge as seen along the longitudinal direction (rotational axis direction) of the photosensitive drum. In this embodiment, constitutions and operations of the residual toner buffering portions attached to the process cartridges for the respective colors are substantially the same except for species (colors) of the residual toners.

Inside the residual toner buffering portion attached to the process cartridge, a residual toner feeding screw 23 as the residual toner feeding member is provided. The residual toner feeding screw 23 for each color is driven by a driving motor (not shown) as a driving means provided independently of the driving system for the photosensitive drum 10. The residual toner feeding screw 23 is rotationally driven by receiving a driving force of the driving motor. Then, by the rotational drive of the residual toner feeding screw 23, the transfer residual toner dropped in the residual toner buffering portion is fed into a residual toner container 300 (FIG. 3) as a developer container attached to the image forming apparatus.

(Residual Toner Feeding Control)

Figure 4:
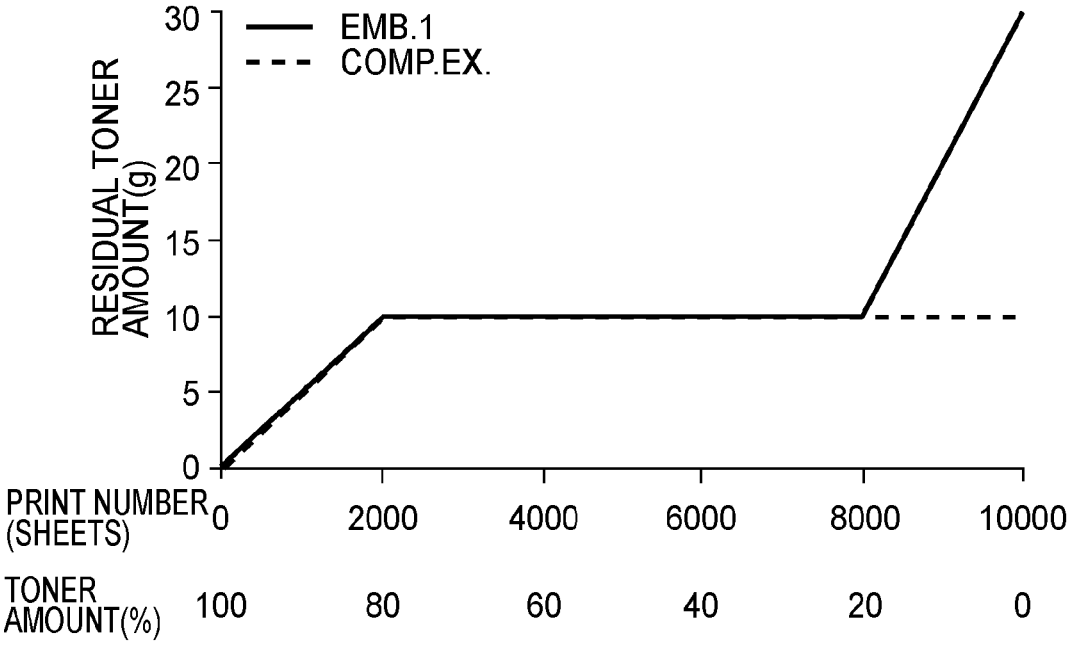
FIG. 4 is a graph for illustrating residual toner feeding control in the First Embodiment.

Next, residual toner feeding control in this embodiment will be described specifically. FIG. 4 is a graph showing progression of a residual toner amount in the residual toner buffering portion attached to the process cartridge. Data in FIG. 4 are those when a lateral line image having a pattern of 5% in print ratio is formed in a one-sheet intermittent manner in an environment of 23° C. in temperature and 50% RH in relative humidity by using the above-described process cartridge in this embodiment. In FIG. 4, the ordinate represents the residual toner amount in the residual toner buffering portion provided in the process cartridge, and the abscissa represents the print manner and the remaining toner amount. A maximum amount of the residual toner capable of being accommodated in the residual toner buffering portion of the process cartridge in this embodiment is 30 g.

A driving speed of the residual toner feeding screw disposed in the residual toner buffering portion of the process cartridge is set at a speed at which the residual toner does not overflow the residual toner buffering portion of the process cartridge even in the case where the amount of the transfer residual toner per sheet is largest. That is, even in the case where a solid black image is continuously printed, the residual toner feeding screw is rotationally driven at a sufficient speed at which the residual toner does not overflow the residual toner buffering portion of the process cartridge.

(Residual Toner Feeding Control in Comparison Example)

First, as Comparison Example to be compared with this embodiment (First Embodiment), residual toner feeding control in the case where the residual toner feeding screw 23 is continuously driven during image formation until the process cartridge reaches an end of its lifetime. In FIG. 4, a broken line represents the progression of the residual toner amount in the residual toner buffering portion of the process cartridge during sheet passing in the case where the residual toner feeding screw 23 is continuously driven during the image formation.

The transfer residual toner removed from the photosensitive drum slightly moves in a longitudinal direction in the residual toner buffering portion of the process cartridge until the transfer residual toner accumulates in an amount of 10 g at the residual toner buffering portion of the process cartridge. This is because unless the residual toner accumulates at a level of the neighborhood of a shaft center of the residual toner feeding screw 23 disposed in the residual toner buffering portion of the process cartridge, when the residual toner is stirred by a blade of the residual toner feeding screw 23, the residual toner cannot move to an adjacent blade portion downstream with respect to a (developer) feeding direction.

When the residual toner accumulates at the level of the neighborhood of the shaft center of the residual toner feeding screw 23 of the process cartridge, movement of the toner is generated toward a downstream side of the feeding direction. Then, the residual toner in the residual toner buffering portion of the process cartridge is fed into the residual toner container attached to the main assembly.

The residual toner feeding screw is continuously driven during the image formation, and therefore the process cartridge reaches the end of its lifetime while keeping the residual toner amount of 10 g, which is a starting amount of the residual toner feeding, in the residual toner buffering portion of the process cartridge. Accordingly, only 10 g of the residual toner exists in the residual toner buffering portion of the process cartridge when the process cartridge reaches the end of its lifetime.

(Residual Toner Feeding Control in this Embodiment)

The residual toner feeding control in this embodiment using a control means (CPU) 150 (FIG. 1) is effected depending on an operation (use) status of the process cartridge in order to fill the buffering portion with the residual toner when the end of the lifetime of the process cartridge approaches zero will be described. In this embodiment, the residual toner feeding control is effected on the basis of toner amount information stored in the storing device disposed on the process cartridge. Specifically, the remaining toner amount as a threshold of the residual toner feeding control is taken as 80% (print number: 8000 sheets).

Figure 5:
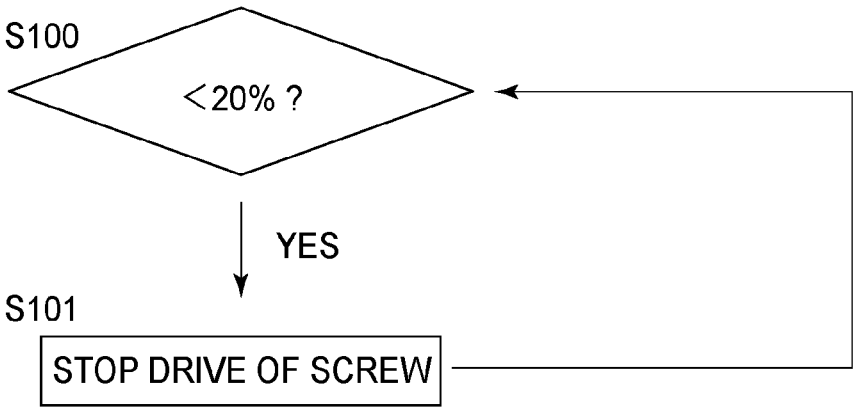
FIG. 5 is a flowchart for illustrating the residual toner feeding control in the First Embodiment.

FIG. 5 is a flowchart showing the residual toner feeding control in this embodiment. In this embodiment, detection of the toner amount is made using an optical sensor, but pixel count information of a print may also be used. Also in this case, similar control can be effected. In FIG. 5, first, when a print job is set to the image forming apparatus, in a step S100, whether or not the remaining amount is less than 20% is discriminated. When the remaining toner amount is 20% or more, the step S100 is performed again in a subsequent print job. When the remaining toner amount is less than 20%, the sequence goes to a step S101, in which the drive of the residual toner feeding screw 3 is stopped.

In FIG. 4, a solid line shows progression of the remaining toner amount in the residual toner buffering portion of the process cartridge during the sheet passing in the case where the residual toner feeding in the residual toner buffering portion of the process cartridge is stopped when the remaining toner amount reaches 20%. Until the remaining toner amount reaches 20%, similarly as in the residual toner feeding control described above as a Comparison Example, the remaining toner amount in the residual toner buffering portion of the process cartridge is continuously kept at 10 g.

After the remaining toner amount reaches less than 20% and the drive of the residual toner feeding screw 23 is stopped, the residual toner amount in the residual toner buffering portion of the process cartridge continuously increases, so that 30 g of the residual toner is accumulated in the residual toner buffering portion when the remaining toner amount reaches 0%. That is, the residual toner buffering portion of the process cartridge is in a state filled with the residual toner.

By effecting this control, it becomes possible to effectively use a space in the residual toner buffering portion of the process cartridge. That is, the amount of the residual toner fed from the process cartridge to the residual toner container attached to the main assembly can be reduced by 20 g per one process cartridge, and therefore a lifetime of the residual toner container attached to the main assembly can be prolonged.

Modified Embodiment 1

The residual toner feeding control can also be effected on the basis of not only the remaining toner amount but also a remaining lifetime of the photosensitive drum as the image bearing member, the developing roller as the toner carrying member, or the like. That is, either one of the remaining toner amount in the process cartridge, a traveling distance of the image bearing member and a traveling distance of the toner carrying member is stored as the threshold in the storing means for storing the operation status of the process cartridge, and when the amount or the distance reaches the threshold, the drive of the residual toner feeding screw 23 is stopped. As a result, when the lifetime of the process cartridge reaches the end thereof (remaining toner amount: 0%), the residual toner buffering portion of the process cartridge can be placed in the filled state with the residual toner.

In this embodiment, the residual toner feeding member is continuously driven during the image formation, but a similar effect can be obtained also in the case where the residual toner feeding member is intermittently driven.

Second Embodiment

In the First Embodiment, in order to effect the residual toner feeding control, on the basis of the remaining toner amount information stored in the storing device disposed on the process cartridge, the drive of the residual toner feeding member in the residual toner buffering portion of the process cartridge was uniquely stopped. A difference of this embodiment from the First Embodiment is only that the remaining toner amount in the residual toner buffering portion of the process cartridge until the process cartridge reaches the end of its lifetime is estimated from the operation status of the process cartridge and then the drive of the residual toner feeding member is stopped depending on an estimation result.

Other constitutions of the residual toner feeding and the constitution of the image forming apparatus are similar to those in the First Embodiment, and therefore will be omitted from description, and of the residual toner feeding control, only a portion relating to residual toner amount estimation, on the basis of the operation status of the process cartridge, until the process cartridge reaches the end of its lifetime will be described.

Figure 6:
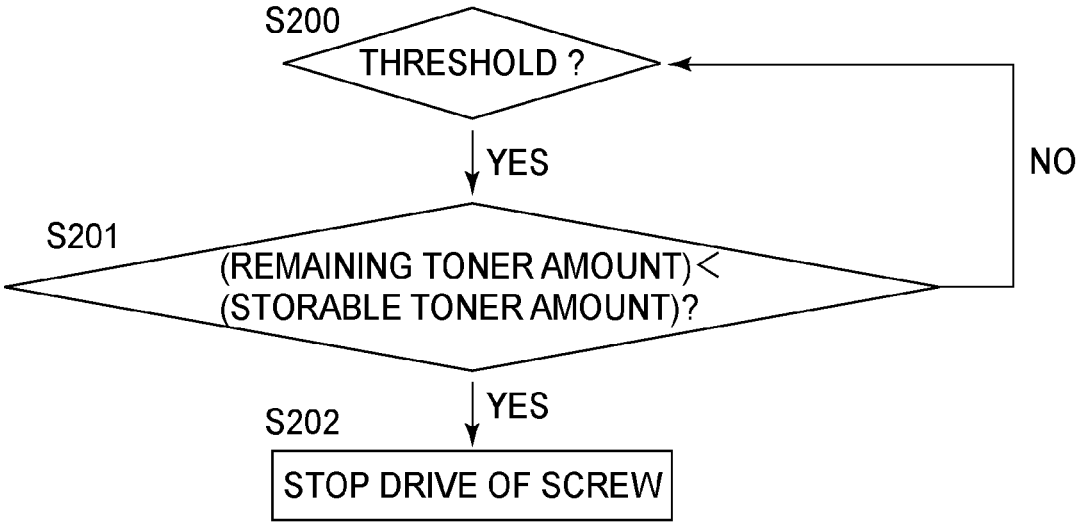
FIG. 6 is a flowchart for illustrating residual toner feeding control in a Second Embodiment of the present invention.

FIG. 6 is a flowchart showing the residual toner feeding control in this embodiment. In this embodiment, the residual toner amount estimation until the process cartridge reaches the end of its lifetime is carried out on the basis of developing roller lifetime information stored in the storing device disposed on the process cartridge. The developing roller lifetime was total number of rotation of the developing roller or the traveling distance of the developing roller. This is because by the rotation of the developing roller, the toner slides against the developing blade and the supplying roller deteriorates, generating image defects.

(Timing of Estimation)

In this embodiment, the estimation of the residual toner amount (developer amount) in the residual toner buffering portion of the process cartridge is executed with every 5% reduction in remaining amount of the developing roller lifetime. That is, a value is obtained with every 5% reduction in the remaining amount of the developing roller lifetime from 100% in taken as an estimation threshold. Specifically, first estimation of the residual toner amount in the residual toner buffering portion of the process cartridge is made when the remaining amount of the developing roller lifetime reaches 95%. Then, second estimation is made when the remaining amount of the developing roller lifetime reaches 90%, and thereafter the estimation of the residual toner amount is repeated until the remaining amount of the developing roller lifetime reaches 5%.

As shown in FIG. 6, first, in a step S200, when the remaining amount of the developing roller lifetime reaches the threshold based on which the residual toner amount estimation mode until the process cartridge reaches the end of its lifetime, the sequence goes to step S201. On the other hand, when the remaining amount of the developing roller lifetime does not reach the threshold, the step S200 is performed again in a subsequent job.

(Estimated Amount and Properness Discrimination of Drive Stop)

In the step S201, the residual toner amount from the time of the estimation until the remaining amount of the developing roller lifetime reaches 0% is estimated. When the estimated residual toner amount is smaller than the amount of the residual toner storable in a free space of the residual toner buffering portion of the process cartridge, the sequence goes to a step S202. Then, the drive of the residual toner feeding screw 23 disposed in the residual toner buffering portion of the process cartridge is stopped. When the estimated amount is larger than the amount of the residual toner storable in the free space of the residual toner buffering portion of the process cartridge, the step S200 is performed again in a subsequent job without stopping the drive of the residual toner feeding screw 23.

(Concretization of Estimation)

The estimation of the residual toner amount in the process cartridge is made using the information on the operation status of the process cartridge at the time of the estimation, and the estimated amount is obtained from the following calculation formula.

(Residual toner amount from the time of estimation until recording material of developing roller lifetime reaches 0%)=(Average print ratio of printing mode until estimation is executed)×(1−Transfer efficiency)

In this embodiment, when the residual toner amount in the residual toner buffering portion is estimated, the operation status of the process cartridge is stored for the remaining amount of the developing roller lifetime (the total number of rotations of the developing roller or the traveling distance of the developing roller) in the storing device attached to the process cartridge. Specifically, a transfer efficiency depending on an environment and the remaining amount (degree of deterioration) of the toner is stored as a value depending on the environment and the remaining amount (degree of deterioration) of the toner, in the storing device attached to the process cartridge.

(Free Space in Residual Toner Buffering Portion and Estimated Amount of Residual Toner)

The free space in the residual toner buffering portion of the process cartridge in this embodiment is a volume in which 20 g of the residual toner can be accumulated, irrespective of the print ratio. That is, even in the case where the transfer residual toner amount per (one) sheet is largest, i.e., in the case where the solid black image is continuously printed, the toner is prevented from overflowing the residual toner buffering portion of the process cartridge. This is because the residual toner feeding screw 23 driven for feeding the residual toner container provided in the apparatus main assembly is rotationally driven at a sufficient speed.

Figure 7:
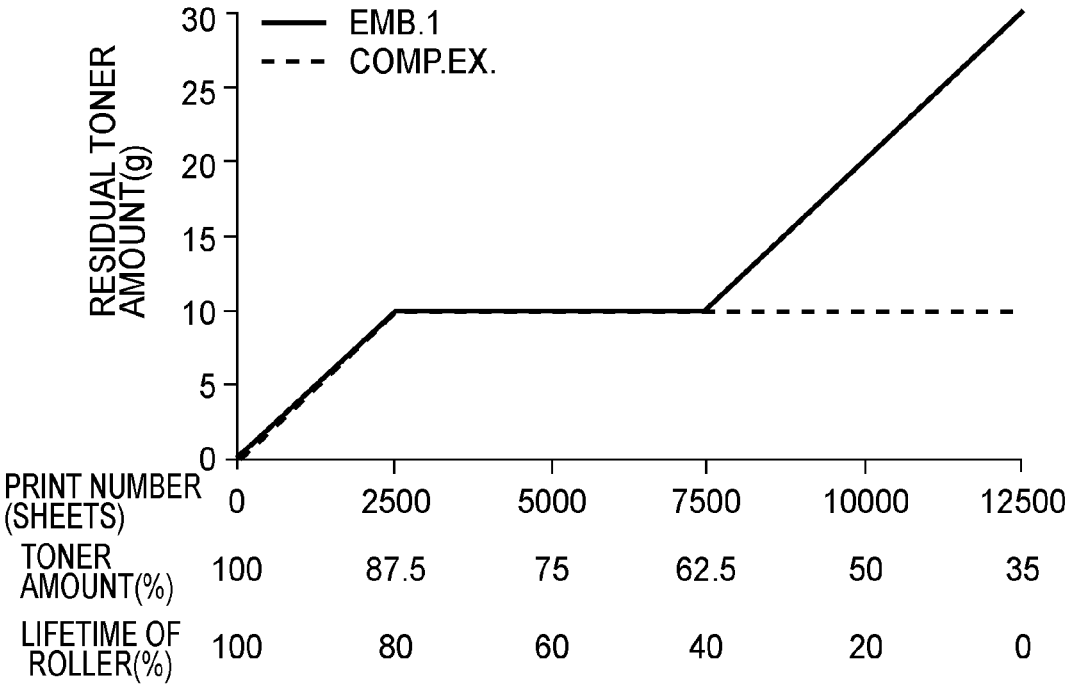
FIG. 7 is a graph for illustrating progression of an estimated amount of a residual toner in a residual toner buffering portion in a Third Embodiment of the present invention.

FIG. 7 shows progression of the estimated amount of the residual toner in the residual toner buffering portion of the process cartridge in the case where the residual toner feeding control in this embodiment is effected. The data shown in FIG. 7 are those when a lateral image having a pattern of 2.5% in print ratio is formed in a one-sheet intermittent manner in an environment of 23° C. in temperature and 50% RH in relative humidity by using the process cartridge described in the First Embodiment.

In FIG. 7, the broken line shows the progression of the residual toner amount in the residual toner buffering portion of the process cartridge in the case where the residual toner feeding control is effected in the First Embodiment in which the remaining toner amount threshold for the residual toner feeding control is 20%. As shown in FIG. 7 by the broken line, in the case of the print ratio of 2.5%, by passing 2500 sheets, the residual toner amount reaches 10, in which the residual toner can be fed to the residual toner container. Then, the residual toner feeding screw is continuously driven until the remaining toner amount reaches the threshold of 20%.

However, the print ratio is low, and therefore the developing roller lifetime becomes 0% before the remaining toner amount reaches the threshold of 20%, so that the process cartridge reaches the end of its lifetime. That is, a decreasing speed of the remaining toner amount is slower than that in the First Embodiment, while a decreasing speed of the developing roller lifetime is the same as that in the First Embodiment, and therefore the developing roller lifetime reaches 0% before the remaining toner amount reaches the threshold of 20%. That is, in the case where the print ratio is low, the lifetime of the process cartridge is determined by the developing roller lifetime. For this reason, in the case where the print ratio is low, the residual toner feeding screw cannot be stopped, so that the residual toner cannot be accumulated in the residual toner buffering portion in the process cartridge.

In FIG. 7, the solid line shows the progression of the residual toner amount in the residual toner buffering portion of the process cartridge in the case where the residual toner feeding control in this embodiment in which the residual toner feeding screw is stopped at the time when the sheet passing number reaches 7500 sheets (developing roller lifetime remaining amount: 40%). In this embodiment, at the time when the sheet passing number reaches 7500 sheets, the residual toner amount estimation until the process cartridge reaches the end of its lifetime is made, and the estimation that the accommodation of the transfer residual toner into the residual toner buffering portion is permitted is made and the drive of the residual toner feeding screw is stopped. In this embodiment, at the time at which the developing roller lifetime amount is 0%, the residual toner buffering portion is filled with the residual toner.

In the case where the print ratio is 2.5%, at the time when the sheet passing number is 4500 sheets (developing roller lifetime remaining amount: 64%), the estimated amount of the residual toner in the residual toner buffering portion of the process cartridge is as follows. That is, the estimated amount is smaller than the amount of the residual toner capable of being accumulated in the residual toner buffering portion of the process cartridge. At this time, the drive of the residual toner feeding screw 23 is stopped.

As a result, 30 g of the residual toner is accumulated in the residual toner buffering portion of the process cartridge at the time of the developing roller lifetime remaining amount is 0%. That is, the residual toner buffering portion of the process cartridge is in a filled state with the residual toner.

Also after the drive of the residual toner feeding screw 23, the above estimation is made in the case where the remaining amount of the developing roller lifetime reaches the threshold at which the estimation of the residual toner amount until the process cartridge reaches the end of its lifetime is made (in the case where the remaining amount of the developing roller lifetime becomes a value lowered from 100% by 5% every estimation). Then, when the estimated amount is smaller than the amount of the residual toner capable of being accumulated in the free space of the residual toner buffering portion of the process cartridge, the drive of the residual toner feeding screw 23 is kept stopped. When the estimated amount is larger than the amount of the residual toner capable of being accumulated in the free space of the residual toner buffering portion of the process cartridge, the drive of the residual toner feeding screw 23 is resumed.

By employing the control in this embodiment, even in the case where the process cartridge does not reach the end of its lifetime at the remaining toner amount threshold, the residual toner amount until the time when the process cartridge reaches the end of its lifetime can be estimated for every remaining amount of the developing roller lifetime. As a result, at the time when the process cartridge reaches the end of its lifetime, the residual toner buffering portion of the process cartridge can be filled with the toner. That is, as in this embodiment, the residual toner feeding control is effected on the basis of remaining amount information of the developing roller lifetime, so that irrespective of the operation status of the process cartridge, it becomes possible to effectively use the space of the residual toner buffering portion of the process cartridge.

By effecting the above control, the amount of the residual toner fed from the process cartridge to the residual toner container can be reduced by 20 g per one process cartridge, so that the lifetime of the residual toner container can be extended.

In this embodiment, in the calculation formula for estimating the residual toner amount in the process cartridge, the transfer efficiency depending on the environment and the remaining toner amount was used, but it is also possible to use the following calculation formula relating to the lifetime of the process cartridge.

(Residual toner amount from the time of estimation to developing roller lifetime remaining amount of 0%)=(Average print ratio of printing made until estimation)×(Developing roller lifetime remaining amount)

Modified Embodiment 2

As the remaining amount of the process cartridge lifetime is stored at every predetermined value, it is also possible to use a remaining amount of a lifetime of the photosensitive drum or the like in place of the developing roller lifetime remaining amount.

Third Embodiment

In the First Embodiment, in order to effect the residual toner feeding control, on the basis of the remaining toner amount information stored in the storing device disposed on the process cartridge, the drive of the residual toner feeding member was uniquely stopped. Further, in the Second Embodiment, based on the developing roller lifetime remaining amount stored in the storing device disposed on the process cartridge in order to effect the residual toner feeding control, the drive of the residual toner feeding member was stopped on the basis of a relationship between the estimated residual toner amount and the size of the free space of the buffering portion.

A difference of this embodiment from the Second Embodiment is only that in the case where at least one of the process cartridges for the respective colors satisfies a drive stopping condition of the residual toner feeding member, the drive of the residual toner feeding member of the remaining process cartridges is stopped.

Other constitutions of the residual toner feeding and the constitution of the image forming apparatus are similar to those in the First Embodiment, and therefore will be omitted from description, and only a portion of the residual toner feeding control relating to the stop of the drive of the residual toner feeding member will be described.

Figure 8:
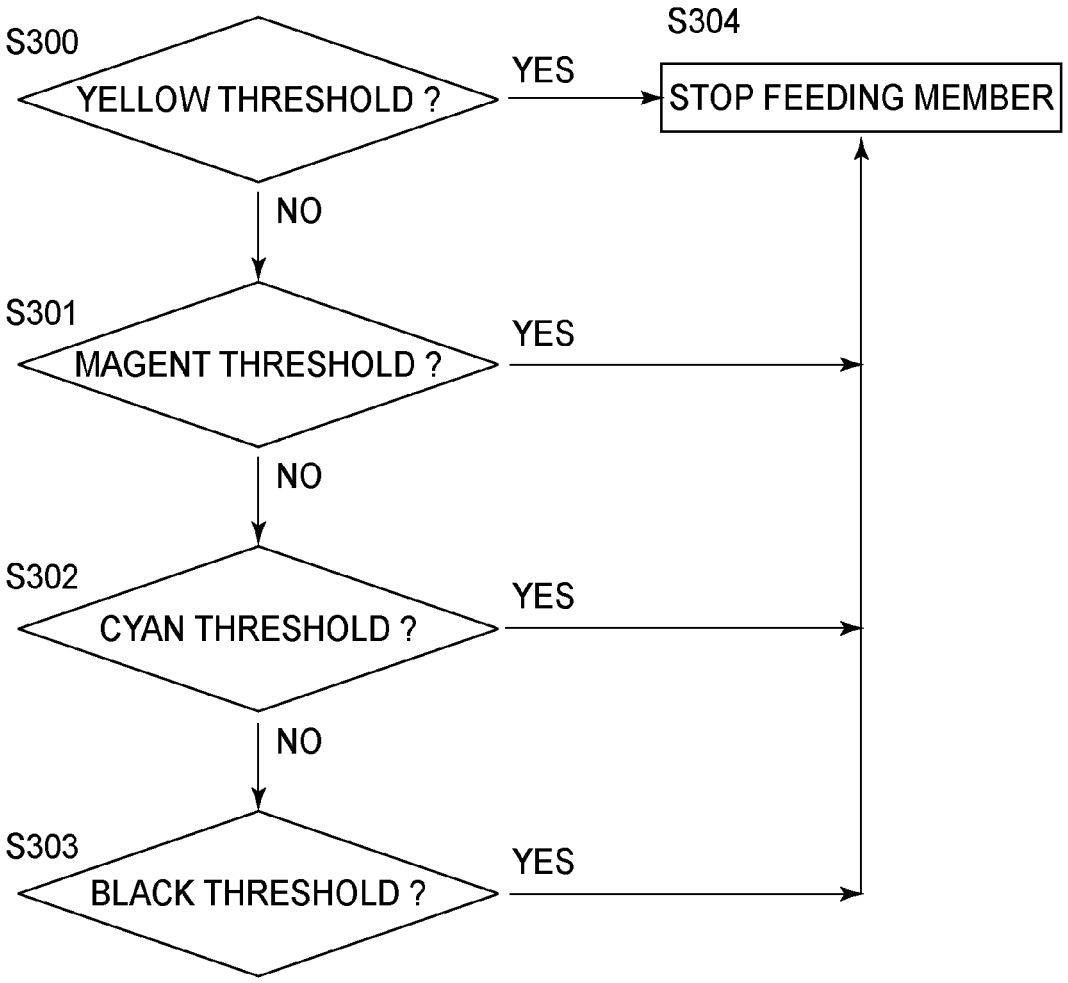
FIG. 8 is a flowchart for illustrating residual toner feeding control in the Third Embodiment.

FIG. 8 is a flowchart showing the residual toner feeding control in this embodiment. In this embodiment, remaining toner amount information is used for discriminating whether or not the drive of the residual toner feeding screw 23 should be stopped. First, in a step S300, whether or not the remaining toner amount of the yellow process cartridge of the process cartridges for the respective colors reaches the threshold (20%) at which the drive of the residual toner feeding screw 23 is stopped. In the case where the remaining toner amount reaches the threshold (20%) for the yellow process cartridge, in a step S304, the drive of the residual toner feeding screw 23 is stopped.

Further, in the case where the remaining toner amount does not reach the threshold (20%) for the yellow process cartridge, in the step S301, whether or not the remaining toner amount of the magenta process cartridge of the process cartridges for the respective colors reaches the threshold (20%) at which the drive of the residual toner feeding screw 23 is stopped. In the case where the remaining toner amount reaches the threshold (20%) for the magenta process cartridge, in the step S304, the drive of the residual toner feeding screw 23 is stopped.

Further, in the case where the remaining toner amount does not reach the threshold (20%) for the magenta process cartridge, in the step S302, whether or not the remaining toner amount of the cyan process cartridge of the process cartridges for the respective colors reaches the threshold (20%) at which the drive of the residual toner feeding screw 23 is stopped. In the case where the remaining toner amount reaches the threshold (20%) for the cyan process cartridge, in the step S304, the drive of the residual toner feeding screw 23 is stopped.

Further, in the case where the remaining toner amount does not reach the threshold (20%) for the cyan process cartridge, in the step S303, whether or not the remaining toner amount of the black process cartridge of the process cartridges for the respective colors reaches the threshold (20%) at which the drive of the residual toner feeding screw 23 is stopped. In the case where the remaining toner amount reaches the threshold (20%) for the black process cartridge, in the step S304, the drive of the residual toner feeding screw 23 is stopped.

Further, in the case where the remaining toner amount does not reach the threshold (20%) for the black process cartridge, the step S300 is performed again in a subsequent printing job.

When the remaining toner amount becomes 0% and the process cartridge in which the residual toner buffering portion is filled with the residual toner is exchanged with a new process cartridge, the drive of the residual toner feeding screw 23 is resumed. When a trigger is met wherein one of the process cartridges reaches a remaining toner amount of 20%, the following operation is performed when the remaining toner amount in that process cartridge reaches 0% in the case where the drive of the residual toner feeding screw 23 is stopped. That is, in the case where the remaining toner amount of at least one of the remaining three process cartridges reaches 20% which is the stopping condition of the drive of the residual toner feeding screw 23, the remaining toner amount threshold is changed, and then the drive of the residual toner feeding screw 23 is continuously driven.

Specifically, in the case where the remaining amount of the yellow process cartridge is 20% and the remaining toner amount of the magenta process cartridge is 40% and then the drive of the residual toner feeding screw is stopped, the following operation is performed. That is, when the remaining toner amount of the yellow process cartridge reaches 0%, the remaining toner amount of the magenta process cartridge is 20%. At this time, the residual toner buffering portion of the yellow process cartridge is filled with the toner and then is exchanged. Further, the remaining toner amount of each of the remaining three process cartridges is 20% in a state in which the residual toner buffering portion is filled with the toner, so that the remaining toner amount reaches the threshold of the stop of the drive of the residual toner feeding screw 23.

In this state, when the drive of the residual toner feeding screw 23 is stopped, the residual toner overflows the process cartridges other than the yellow process cartridge, so that generating an image defect. Therefore, in this embodiment, the remaining toner amount threshold as the stopping condition of the drive of the residual toner feeding screw 23 for the magenta process cartridge is changed from 20% to 18%, and then the residual toner in the residual toner buffering portion is sent to the residual toner container attached to the apparatus main assembly.

As a result, the amount of the residual toner in the residual toner container of the process cartridge can be reduced to 10 g in which the residual toner cannot be fed by the residual toner feeding screw 23. At the time when the remaining toner amount reaches the remaining toner amount threshold (18%), the drive of the residual toner feeding screw 23 is stopped. By effecting the above control, it becomes possible to reduce the amount of the residual toner fed from the process cartridge to the residual toner container attached to the image forming apparatus by 20 g per one process cartridge. As a result, the lifetime of the residual toner container can be prolonged.

The residual toner feeding control in this embodiment can also be effected using not only the remaining toner amount but also the lifetime of the photosensitive drum, the developing roller or the like as in Modified Embodiment 1 of the First Embodiment. Further, as in the Second Embodiment, the residual toner amount until the process cartridge reaches the end of its lifetime is estimated on the basis of the lifetime information of the developing roller or the photosensitive drum, and then it is also possible to make discrimination as to whether or not the drive of the residual toner feeding member should be stopped.

Modified Embodiment 3

Preferred embodiments of the present invention were described above, but the present invention is not limited thereto and can be modified and changed in various manners within the scope of the present invention. For example, in the above-described embodiments, as the cartridge, the process cartridge was described, but the present invention is not limited thereto. The present invention is also applicable to the case where a photosensitive (member) cartridge (including the photosensitive drum 10 and the cleaning unit 12) from which the developing device is separated is used as the cartridge and the case where the cleaning unit 12 is used as the cartridge, for example.

According to the present invention, it is possible to provide an image forming apparatus capable of realizing the lifetime extension of a residual toner container (developer container) using a developer buffering portion without relying on an increase in space of the residual toner container (developer container) attached to the image forming apparatus.

While the invention has been described with reference to the structures disclosed herein, it is not confined to the details set forth and this application is intended to cover such modifications or changes as may come within the purpose of the improvements or the scope of the following claims.

This application claims the benefit of Japanese Patent Application No. 2014-179992 filed on Sep. 4, 2014, which is hereby incorporated by reference herein in its entirety.

What is claimed is:

1. An image forming apparatus comprising:

an image bearing member;

a developer carrying member for carrying developer;

a cartridge detachably mountable to a main assembly of said image forming apparatus, said cartridge including (i) a cleaning member configured to remove the developer remaining on said image bearing member after a developer image is transferred onto a transfer material, (ii) a developer buffering portion for accommodating the developer being removed by said cleaning member, and (iii) a feeding member driven for feeding the developer from said developer buffering portion to a developer container provided in the main assembly; and a controller configured to control said feeding member to stop the drive of said feeding member, wherein said controller stops said feeding member when an estimated amount of toner to be removed by said cleaning member during a remaining lifetime of the cartridge is less than an amount of the developer storable in the developer buffering portion.

2. An image forming apparatus according to claim 1, wherein said cartridge includes said image bearing member.

3. An image forming apparatus according to claim 1, wherein said cartridge is a process cartridge including said image bearing member and said developer carrying member.

4. An image forming apparatus according to claim 1, further comprising a storing member configured to store lifetime information of said cartridge, wherein the controller controls said feeding member to stop the drive of said feeding member on the basis of the lifetime information of said cartridge stored in said storing member, and said storing member is provided on said cartridge, and said controller is provided in the main assembly.

5. An image forming apparatus according to claim 4, wherein as the lifetime information of said cartridge, a remaining developer amount is stored as a threshold of said controller in said storing member.

6. An image forming apparatus according to claim 5, wherein said controller stops the drive of said feeding member when the remaining developer amount reaches the threshold.

7. An image forming apparatus according to claim 4, wherein as the lifetime information of said cartridge, a traveling distance of said image bearing member is stored as a threshold of said controller in said storing member.

8. An image forming apparatus according to claim 4, wherein as the lifetime information of said cartridge, a traveling distance of said developer carrying member is stored as a threshold of said controller in said storing member.

9. An image forming apparatus according to claim 4, wherein the lifetime information of said cartridge is stored at every predetermined value of the remaining lifetime of said cartridge, and wherein said controller estimates a developer amount to be located in said developer buffering portion every said predetermined value until said cartridge reaches an end of the lifetime thereof, and stops the drive of said feeding member when the developer amount is determined as being smaller than a free space of said developer buffering portion.

10. An image forming apparatus according to claim 9, wherein the lifetime information of said cartridge is information of a remaining lifetime of said developer carrying member.

11. An image forming apparatus according to claim 9, wherein the lifetime information of said cartridge is information of a remaining lifetime of said image bearing member.

12. An image forming apparatus according to claim 9, wherein in said storing member, a transfer efficiency for estimating the developer amount is stored.

13. An image forming apparatus according to claim 12, wherein the transfer efficiency is stored depending on an environment and the remaining developer amount.

14. An image forming apparatus according to claim 12, wherein the transfer efficiency is stored depending on an environment and a traveling distance of said developer carrying member.

15. An image forming apparatus according to claim 1, wherein in said storing member, an average print ratio per sheet is stored.

16. An image forming apparatus according to claim 1, wherein said cartridge is provided correspondingly to each of a plurality of colors, and when the drive of said feeding member of said cartridge for at least one color is stopped, the drive of said feeding member of said cartridge for each of the remaining colors of the plurality of colors is stopped.

17. An image forming apparatus according to claim 1, wherein said feeding member is provided inside said buffering portion.

18. An image forming apparatus according to claim 1, wherein said feeding member is driven independently of a driving system for said image bearing member.

* * * * *